United States Patent [19]

Maekawa et al.

[11] Patent Number: 4,745,097

[45] Date of Patent: May 17, 1988

[54] MICROCAPSULE-COATED PAPERS FOR PRESSURE-SENSITIVE COPYING PAPER

[75] Inventors: Masakazu Maekawa; Yasuhiro Ogata, both of Shizuoka, Japan

[73] Assignee: Fuji Photo Film Co., Ltd., Kanagawa, Japan

[21] Appl. No.: 838,498

[22] Filed: Mar. 11, 1986

[30] Foreign Application Priority Data

Mar. 12, 1985 [JP] Japan ..... 60-48937

[51] Int. Cl.[4] ..... B41M 5/16; B41M 5/22

[52] U.S. Cl. ..... 503/209; 427/152; 428/914; 503/215; 503/226

[58] Field of Search ..... 346/200, 209, 215, 226; 427/150, 151, 152; 428/402.21, 402.22, 914; 503/200, 209, 215, 226

[56] References Cited

FOREIGN PATENT DOCUMENTS

| | | | |
|---|---|---|---|
| 0086788 | 6/1980 | Japan | 346/200 |
| 0176194 | 10/1982 | Japan | 346/226 |
| 2125079 | 2/1984 | United Kingdom | 346/226 |

*Primary Examiner*—Bruce H. Hess

*Attorney, Agent, or Firm*—Sughrue, Mion, Zinn, Macpeak, and Seas

[57] ABSTRACT

A microcapsule-coated paper for a pressure-sensitive copying paper comprising a base paper having coated thereon consecutively (a) a subbing layer and (b) a coated layer including microcapsules wherein said subbing layer is capable of aggregating said microcapsules.

7 Claims, No Drawings

MICROCAPSULE-COATED PAPERS FOR PRESSURE-SENSITIVE COPYING PAPER

FIELD OF THE INVENTION

This invention relates to a pressure-sensitive copying paper, and, more particularly, to a microcapsule-coated paper for a pressure-sensitive copying paper.

BACKGROUND OF THE INVENTION

A pressure-sensitive copying paper is generally produced by coating a coating composition mainly composed of microcapsules containing an oil having dissolved therein a substantially colorless electron donating dye (hereinafter referred to simply as microcapsules) and a coating composition mainly composed of an electron accepting developer (hereinafter referred to simply as a developer) on separate base papers or on the same base paper.

A pressure-sensitive copying paper is generally composed of an upper paper (CB (coated back) sheet) having a coated layer of microcapsules and a lower paper (CF (coated front) sheet) having a coated layer of a developer, or is composed of the upper paper, the lower paper, and an intermediate paper (CFB (coated front and back) sheet) having a coated layer of microcapsules on one surface thereof and a coated layer of a developer on the other surface thereof. In one embodiment, the upper paper is superposed on the lower paper so that the coated layers face to each other, or in other embodiment, one or more intermediate papers are inserted between the upper paper and the lower paper, and when pressure is applied to the assembly by a typewriter or hand writing, the microcapsules are raptured to release the oil containing the substantially colorless dye, which is then transferred onto the surface of the developer layer to form colored images.

The microcapsule-coated paper is usually prepared by coating a coating composition composed of microcapsules, a binder, a smudge preventing particles (stilts), etc., on a base paper. However, since a base paper for such a microcapsule-coated paper is porous and does not having sufficient water repellency, the components constituting the coating composition tend to permeate into the base paper after coating the coating composition.

In particular, if microcapsules in the coating composition permeate into the base paper, the rupture of the microcapsules by recording pressure and the transfer of the oil containing a substantially colorless dye onto a developer-coated paper are not effectively performed, thus reducing the coloring density.

Accordingly, in the case of coating on a base paper, it is required to coat a large amount of a coating composition as compared with the case of coating the coating composition on an impermeable support such as a polymer film.

As a method for disposing microcapsules on the surface of a base paper by preventing the permeation of microcapsules into the base paper, there are known the following techniques.

Japanese Patent Publication No. 21,499/68 describes a method wherein one of two kinds of water-soluble polymers forming a coacervate is added to a paper stock for making a base paper and a coating composition containing the other of the water-soluble polymers and microcapsules is coated on the wet paper on a wire cloth of a paper manufacturing machine. However, the above method is not said to be a practical method since it is difficult to coat the coating composition on the wet paper, and even if a coacervate is formed on the wet paper in the presence of a large amount of water, microcapsules permeate into the paper upon drying after the formation of microcapsules, whereby the effective prevention of the permeation of microcapsules cannot be performed.

U.S. Pat. No. 3,914,470 and British Patent No. 1,370,081 describe a method wherein a subbing layer composed of a re-wettable binder such as dextrin, polyvinyl alcohol, etc., and smudge preventing particles (stilts) is formed on a base paper and microcapsules only are coated thereon. According to the method, microcapsules exist on a binder layer and hence the rupture of microcapsules by recording pressure is effectively performed and the transfer of oil onto a developer layer is not disturbed by the binder layer, to give high coloring property. However, for sufficiently preventing the permeation of microcapsules in a base paper, it is required to coat a large amount of a high-viscous binder, but such a coating is impossible by an on-machine lightweight coating such as a size press of a paper machine, and thus it is required to coat the subbing layer and microcapsules by means of separate coating machines; which inevitably results in making the production step complicated and causing increased costs in making the product. Also, if subbing of the binder is sufficiently performed to prevent the permeation of microcapsules, the air resistance of the microcapsule-coated paper becomes very high, and hence there is no surface void for escape of air through the paper, which results in reducing the high-speed runnability of the sheets in a winder, a printing machine, etc. Thus, such a method is also lacking in practicability.

U.S. Pat. No. 3,565,666 and British Patent No. 1,222,187 describe a method for preventing the occurrence of rubbing smudge by forming a subbing layer of a latex. According to the method, the subbing layer of the latex acts as a cushion layer for microcapsules to prevent the occurrence of rubbing smudge. In this case, the subbing layer also acts to prevent the permeation of microcapsules into the base paper, thus improving the coloring property.

However, in the prevention of the permeation of microcapsules by forming a subbing layer of a binder such as the water-soluble polymer as described in aforesaid U.S. Pat. No. 3,914,470 and British Patent No. 1,370,081 and the latex as described in U.S. Pat. No. 3,565,666 and British Patent No. 1,222,187, the permeation of microcapsules is prevented by filling the voids of a base paper by the binder. Hence not only the permeation of microcapsules but also the permeation of a binder in the capsule coating composition are prevented, whereby the binder remains on the surface of the subbing layer. Thus, such methods are not always effective for the improvement of coloring property, and additionally the air resistance of the microcapsule-coated paper is increased according to these methods. Therefore, these methods are not totally suitable for practical use.

U.S. Patent No. 4,219,220 and British Patent No. 2,022,646 describe a method wherein inorganic solid fine particles and an adhesive are coated on a subbing layer on a base paper and a microcapsule-containing coating composition is coated on the subbing layer for preventing the permeation of the coating composition to improve the coloring property. However, in this method, the permeation of microcapsules is prevented also by filling the voids of a base paper and hence there are the same demerits that the binder disturbing the transfer of oil remains on the surface of the subbing layer and the air resistance of the microcapsule-coated paper is increased as the case of aforesaid U.S. Pat. No. 3,565,666 and British Patent No. 1,222,187.

Japanese Patent Application (OPI) No. 211,699/84 provides a method wherein boric acid and/or a borate is coated on a base paper as a subbing layer and a coating composition containing polyvinyl alcohol as an adhesive is coated on the subbing layer, whereby polyvinyl alcohol is aggregated by the action of boric acid or the borate to prevent the permeation of polyvinyl alcohol (The term "OPI" as used herein refers to a "published unexamined Japanese patent application"). However, when this method is applied for the coating of microcapsule-containing coating composition and a microcapsule-containing coating composition containing polyvinyl alcohol is coated on the subbing layer of boric acid and/or a borate, only polyvinyl alcohol as an adhesive remains on the surface thereof, whereby the transfer of the oil released from the microcapsules in the case of applying recording pressure is disturbed to reduce the coloring property.

As described above, a method of effectively performing the prevention of the permeation of microcapsules into a base paper to improve the coloring property while also preventing an increase of the air resistance has not yet been developed.

SUMMARY OF THE INVENTION

An object of this invention is to provide a microcapsule-coated paper for pressure-sensitive copying paper capable of effectively undergoing the rupture of microcapsules and the transfer of oil released from the microcapsules onto the surface of a developer layer to provide a high coloring density, and which is capable of providing a desired coloring density using a smaller coating amount of microcapsules than conventional techniques.

It has now been found that the above object of this invention can be attained by coating a coating composition mainly composed of microcapsules on a subbing layer capable of aggregating microcapsules, whereby the permeation of microcapsules into the base paper is prevented.

That is, as a result of investigations on preventing the permeation of only microcapsules into a base paper, the inventors have discovered that by coating a component having a function of aggregating microcapsules in the microcapsule coating composition on a base paper as a subbing layer for the microcapsule layer, the permeation of microcapsules into the base paper is very effectively prevented, and a microcapsule-coated paper showing high coloring density and having low air resistance is obtained.

DETAILED DESCRIPTION OF THE INVENTION

Since microcapsules generally have anionic charges, they causes aggregation by the action of a flocculant such as a cationic substance, a water-soluble polyvalent metal salt, etc. Thus, when a microcapsule coating composition is coated on a subbing layer composed of such a flocculant previously coated on a base paper according to this invention, the flocculant in the subbing layer reacts with the microcapsules in the microcapsule-containing coating composition to form the aggregations of the microcapsules larger than the voids of the base paper, whereby the permeation of microcapsules into the voids of the base paper is prevented. When microcapsules have cationic charges, it is necessary to aggregate the microcapsules using an anionic flocculant as the subbing layer.

The microcapsule coating composition in this invention is a coating composition mainly composed of microcapsules and further contains, in addition to microcapsules, smudge preventing particles (stilts) for preventing the occurrence of smudge caused by the collapse of the microcapsules by low pressure such as friction, etc., a binder for adhering the microcapsules and the protective substance particles to the base paper, etc. If necessary, a pigment, a surface active agent, etc., may be added to the coating composition.

The microcapsules in this invention are composed of droplets of an oily liquid having dissolved therein basic colorless color former(s) covered with a wall material composed of a macromolecular material or polymer insoluble in both water and the oily liquid, and the mean particle size of the microcapsules is generally from 1 to 20 μm. The amount of said basic colorless color former(s) is in the range of from 1 to 10 wt% based on the total amount of said oily liquid.

As the wall material, a combination of a polycation and a polyanion, such as gelatin and gum arabic; a combination of polycondensation system components such as polyisocyanate and polyamine, polyisocyanate and polyol, urea and formaldehyde, melamine and formaldehyde, etc.; and the like are used.

Methods for producing such microcapsules include a phase separation method from an aqueous solution (e.g., U.S. Pat. Nos. 2,800,457, 2,800,458, Japanese Patent Publication Nos. 16,166/72, 32,755/79, etc.,), an external polymerization method (e.g., Japanese Patent Publication No. 12,518/63, Japanese Patent Application (OPI) Nos. 42,380/72, 8780/75, 9079/76, 66878/77, 84,881/78, 84,882/78, 84,883/78, etc.,), an interface polymerization method (e.g., Japanese Patent Publication Nos. 19,574/63, 446/67, 771/67, 2882/67, 2883/67, 8693/67, 9654/67, 11,344/67, British Patent Nos. 950,443, 1,046,409, etc.), a method of polymerizing a wall-forming material in oil droplets (e.g., Japanese Patent Publication Nos. 9168/61, 45,133/74, etc.), and a melting, dispersing and cooling method (e.g., British Patents 952,807, 965,074, etc.).

For this invention, microcapsules containing a high-anionic sulfonic acid type polymer described in Japanese Patent Application (OPI) Nos. 51,238/81, 40,142/83, etc., are particularly suitable.

The microcapsules contain therein color former(s), that is the substantially colorless dye, dissolved in an oil.

The color former for use in this invention has a property of coloring by giving electron or receiving a proton of acid, etc., and there is no particular restriction on the kind of color formers. Ususlly, a substantially colorless compound including a partial skeleton such as lactone, lactam, sultone, spiropyran, ester, amide, etc., undergoes ring opening or cleavage by contact with a developer.

Practical examples of the colorless color former are Crystal Violet lactone, Benzoyl Leucomethylene Blue, Marichite Green lactone, Rhodamine B lactam, 1,3,3-trimethyl6'-ethyl-8'-butoxyindolinobenzspiropyran, etc.

As the oil for use in this invention, natural oils or synthetic oils may be used, singly or as a mixture thereof. Examples of the oil for use in this invention are cotton seed oil, kerosene, paraffin, naphthene oil, alkylated biphenyl, alkylated terphenyl, chlorinated paraffin, alkylated naphthalene, diarylethane, etc.

As the binder which is used together with microcapsules in this invention, there are, for example, latexes such as a styrene-butadiene rubber latex, a styrene-butadiene-acrylonitrile latex, a styrene-butadienemaleic anhydride copolymer latex, an acrylic ester series latex, a vinyl acetate series latex, etc.; water-soluble natural macromolecular compounds such as protein (e.g., gelatin, gum arabic, albumin, casein, etc.), cellulose (e.g., carboxymethyl cellulose, hydroxyethyl cellulose, etc.), saccharose (e.g., agar, sodium alginate, starch, carboxymethyl starch, starch phosphate, etc.), etc.; and water-soluble synthetic macromclecular compounds such as polyvinylalcohol, polyvinylpyrrolidone, polyacrylic acid, polyacrylamide, an isobutyrene-maleic anhydride copolymer, an ethylene-maleic anhydride copolymer, etc. It is advantageous that the molecular weight of these macromolecular compounds for use as a binder be from 1,000 to 10,000,000, and more preferably from 10,000 to 5,000,000.

A binder which does not cause aggregation or causes only a weak aggregation with a flocculant for use in this invention, such as a cationic substance, a water-soluble polyvalent metal salt, etc., is suitably used in this invention. Accordingly, the use of a water-soluble macromolecular nonionic or weak-charging latex having no or less dissociation group is most suitable for the practice of this invention.

The microcapsule coating composition composed of a mixture of microcapsules which cause aggregation with the subbing layer containing the flocculant and a binder which does not cause aggregation or causes weak aggregation with the subbing layer is coated on the subbing layer formed on a base paper according to this invention, whereby microcapsules only are aggregated, to thereby provide a coated construction capable of preventing the permeation of microcapsules into the base paper and having microcapsules in larger amount at the surface of the paper. By such a coated construction, the rupture of microcapsules by recording pressure and the transfer of oil onto a developer layer surface can be effectively performed to improve the coloring property.

However, if the amount of microcapsules existing at the surface is increased excessively and the amount of the binder is reduced, the smudge density by fiaction, etc., is frequently increased. In such a case, it is necessary to properly control the coloring density and smudge density by controlling the permeation of the binder into the base paper by using a binder having many dissociation groups together with the above-described binder, or by increasing the amount of the binder. In this case, however, the control of the coloring density and smudge density by reducing the amount of microcapsules is advantageous from the viewpoint of cost.

As the smudge preventing particles (stilts) for use in this invention, cellulose fine powders (U.S. Pat. No. 2,711,375), starch particles (e.g., British Patent No. 1,232,347, Japanese Patent Publication Nos. 1178/72, 33,204/73), glass beads (e.g., U.S. Pat. No. 2,655,453), heat-expandable polymer particles (microspheres) (e.g., Japanese Patent Application (OPI) No. 32,013/73), etc., can be used.

The subbing layer in this invention is mainly composed of a flocculant for aggregating microcapsules in a microcapsule coating composition coated thereon, but it may further contain a water-soluble binder, a latex, a pigment, a water repellent, protective substance fine particles, etc., according to the intended purposes. In such a case, however, these additive must be selected that the subbing layer coating composition does not itself undergo aggregation. Also, in the case of using a pigment, a water repellent, etc., such may also have a function of aggregating microcapsules.

Examples of flocculants for aggregating anionic microcapsules include water-soluble cationic polymers, cationic emulsions, cationic fine particles, water-soluble cationic low-molecular weight organic compounds, and water-soluble polyvalent metal salts. Examples of flocculants for aggregating cationic microcapsules include anionic water-soluble polymers, anionic emulsions, anionic fine particles, and water-soluble anionic low-molecular weight organic compounds.

Examples of water-soluble cationic polymers for use as the flocculant in this invention include polyvinylbenzyl-trimethylammonium chloride, polydimethyldiallylammonium chloride, a dimethylallyl ammonium chloride-sulfur dioxide copolymer, polymethacryloyloxyethyltrimethylammonium chloride, polymethacryloyloxyethyl $\mu$-hydroxyethyldimethylammonium chloride, polymethacryloyloxyethyl $\mu$-hydroxy-$\gamma$chloropropyldimethylammonium chloride, a styrene-methacryloyloxyethyl $\beta$-hydroxy-$\gamma$-chloropropyldimethylammonium chloride copolymer, polyvinylamine, polydimethylacrylamide, polydimethylaminopropylacrylamide, polyethyleneimine, quaternary polyethyleneimine, an ionene-type cationic polymer, polyamidepolyamine resin, a polyamide-polyamine-epichlorohydrin resin, poly-4-vinylpyridine, poly-4-vinyl-N-butylpyridinium bromide, poly-2-methyl-1-vinyl imidazole, poly-1-vinyl-2,3-dimethylimidazolium methylsulfate, poly-2-acryloxyethyldimethylsulfonium methylsulfate, a dicyanediamide-formalin condensate, and cationic starch.

Examples of the cationic emulsion for use as the flocculant include a methyl methacrylate-dimethylaminoethyl methacrylate copolymer, a styrene-dimethylaminoethyl methacrylate copolymer, a vinylbenzyltrimethylammonium chloride-divinylbenzene-styrene copolymer, and a methacryloyloxyethyltrimethylammonium chloride-ethylene glycol dimethacrylate-methyl methacrylate copolymer.

Examples of the cationic fine powder for use as the flocculant in this invention include fine urea-formalin resin powders, benzoguanamine resin fine powders, anion exchange resin fine powders, alumina sol, and alumina white.

Examples of the cationic low-molecular weight organic compound for use as the flocculant in this invention include triethylbenzylammonium chloride, tetramethylammonium chloride, trimethyl $\beta$-hydroxy-$\gamma$chloropropylammonium chloride, stearyltrimethylammonium chloride, stearyldimethylbenzylammonium chloride, a fatty acid-polyamine reaction product, and an epichlorohydrin quaternary compound of a fatty acid-polyamine reaction product.

Examples of the water-soluble polyvalent metal salts for use as the flocculant in this invention include aluminum salts such as aluminum sulfate, aluminum chloride, aluminum acetate, poly-aluminum chloride, and basic polyaluminum chloride, calcium salts such as calcium chloride and calcium acetate, magnesium salts such as magnesium chloride and magnesium acetate, barium salts such as barium chloride, zinc salts such as zinc chloride, iron salts such as ferric sulfate, zirconium salts such as zirconium ammonium carbonate, and zirconium acetate.

It is difficult to aggragate neutral microcapsules which comprise a water-soluble polymer having no dissociation group such as polyvinylalcohol and polyethyleneoxide by the floccants for cationic anionic microcapsules. When the microcapsules comprise polyvinylalcohol, such microcapsules can be aggregated by using boric acid or borax as the floccant. When the microcapsules comprise polyethyleneoxide, such microcapsules can be aggregated by using a substance having free carboxyl groups such as a polyacrylic acid as the floccant. If the combination of microcapsules comprising polyvinylalcohol and boric acid or borax as the flouant is employed, polyvinyl alcohol can not be used as the binder.

The above-mentioned floccants are coated on the base paper in amount of from 0.01 to 10 g/m$^2$, preferably in amount of from 0.1 to 2 g/m$^2$.

The base paper for use in this invention is mainly composed of wood pulp and may contain, if desired, a synthetic pulp, inorganic fibers, etc.

As a sizing agent for use in this invention, there are saponified rosin, a rosin emulsion, an alkenylsuccinate, an alkenyl succinic anhydride emulsion, an alkylketene dimer emulsion, a fatty acid salt, a fatty acidpolyamine reaction product, a fatty acid-polyamineepichlorohydrin reaction product, a styrene-dimethylaminoethyl methacrylate copolymer, etc. Also, the base paper for use in this invention may contain a size fixing agent such as aluminum sulfate, a cationic polymer, etc.

Furthermore, the base paper for use in this invention may contain a filler such as clay, talc, calcium carbonate, a urea resin fine powder, etc.; a paper strength increasing agent such as polyacrylamide, starch, etc.; a wet strength increasing agent such as a melamine resin, a urea resin, a polyamide-polyamine-epichlorohydrin resin, etc.; and a color tone controlling agent such as dye(s), fluorescent dye(s), etc.

The base paper for use in this invention is preferably produced using a Foudrinier paper machine with multi-cylinder dryers, Foudrinier paper machine with Yankee dryer, etc.

It is preferred that the subbing coating composition for aggregating microcapsules is coated by using an on-machine coater such as a size press, Billblade coater, a roll coater, etc.

A developer which is coated for providing a developer-coated paper for use as a combination with the microcapsule-coated paper, or coated on the opposite surface of a microcapsule-coated paper to the microcapsule layer has a property of accepting electrons or donating protons, and is an adsorptive or reactive compound capable of coloring by contact with the above-described color former(s). Examples of the developer include clay minerals such as acid clay, bentonite, kaolin, etc., phenol-formalin novolak, metal-treated novolak, a metal salt of an aromatic carboxylic acid, etc.

The developer coating composition for use in this invention may contain inorganic pigments such as talc, clay, aluminum hydroxide, calcium carbonate, kaolin, calcinated kaolin, acid clay, diatomaceous earth, zeolite, active clay, zinc oxide, magnesium oxide, etc., and binders such as a carboxylated styrene-butadiene latex, polyvinyl alcohol, starch, hydroxyethylcellulose, etc.

It is preferred that the developer, inorganic pigment particles, etc., are dispersed as fine particles of less than 8 μm by means of a dispersing machine using equipment such as a sand mill, an Attritor ball mill, a horizontal type sand mill (Dynomill), etc.

Various additives such as binders, antioxidants, smudge preventing agents (protective substances or stilts), surface active agents, etc., for use together with the developer or the color former described above, the coating methods, and the using methods thereof are described in U.S. Pat. Nos. 2,711,375, 3,625,736, British Patent No. 1,232,347, Japanese Patent Application (OPI) Nos. 44,012/75, 50,112/75, 127,718/75, 30,615/75, U.S. Pat. Nos. 3,836,383, 3,846,331, etc.

For the developer-coated paper, a base paper produced, e.g., by the ordinary a Fourdrinier paper machine with multi-cylinder dryers, or by a Fourdrinier paper machine with Yankee dryer, can be used.

For coating the microcapsule coating composition or the developer coating composition in this invention, the known various coating methods such as a curtain coating method, an air knife coating method, a bar coating method, a blade coating method, a rod coating method, a roller coating method, a fountain blade coating method, a glavure coating method, a spray coating method, a dip coating method, an extrusion coating method, etc., can be employed. They are described, for example, in Japanese Patent Publication No. 35,330/74, British Patent No. 1,339,082, 1,176,469, U.S. Pat. Nos. 3,186,851, 3,472,674, etc.

Furthermore, a simultaneous multilayer coating apparatus as disclosed in Japanese Patent Publication No. 12,390/70 can be used for coating the subbing layer and the microcapsule layer.

As the steps other than the coating step, known steps can be used. That is, as a drying step for the above-described coated layers, there are a step of drying by blowing air onto the coated surface while conveying the coated web paper by supporting the opposite surface to the coated layer with rolls without using canvas, a step of drying by blowing air onto both the surfaces while conveying the paper web with air support, and a step of winding the coated web paper around a hot cylinder and drying it using an air cap.

The invention is described in more detail by referring to the examples below, in which all parts and percentages are by weight.

The microcapsule dispersion and the developer-coated paper (lower paper) used in the examples and the comparative examples shown below were prepared as follows. Preparation of microcapsule dispersion:

An o/w (oil-in-water) type emulsion having a mean particle size of 4.5 μm was prepared by dispersing 100 parts of diisopropylnaphthalene containing 2.5% of crystal violet lactone and 2% of benzoyl leuco methylene blue in 100 parts of a 4.4% aqueous solution of a partial sodium salt of polyvinylbenzene-silfonic acid (mean molecular weight of 500,000) having adjusted pH of 4.

Apart from this, a mixture of 6 parts of melamine, 11 parts of a 37% aqueous formaldehyde solution, and 83 parts of water was stirred at 60° C. for 30 minutes to provide a transparent aqueous solution of a mixture of melamine, formaldehyde, and a melamine-formaldehyde initial condensate. The aqueous solution of the mixture was mixed with the above-described emulsion, the pH of the resultant mixture was adjusted to 6.0 using an aqueous 20% acetic acid solution with stirring, then the temperature of the mixture was raised to 65° C., and the mixture was maintained at that temperature for 30 minutes to complete the microcapsulation.

Preparation of developer-coated paper

After dispersing 25 parts of active clay, 75 parts of calcium carbonate, 10 parts of zinc oxide, 10 parts of zinc 3,5-di-α-methylbenzylsalicylic acid, and 1 part of sodium hexametaphosphate in 200 parts of water by means of a Kady mill, the dispersion was further finely dispersed using a horizontal type sand mill (DYNO-MILL, made by Willy A. Bachofen AG Machinenfabric) until the volume average particle size thereof became less than 3 μm. The volume average particle size, (ϕ) is determined by the following relationships:

$$\frac{4}{3}\pi\left(\frac{\phi}{2}\right)^3 = \left(\frac{\text{The total volume of particles}}{\text{The total number of particles}}\right)$$

$$\phi = \left(\frac{6}{\pi} \times \frac{\text{The total volume of particles}}{\text{The total number of particles}}\right)^{\frac{1}{3}}$$

The dispersion thus obtained was added to a mixed binder of 125 parts of an 8% aqueous solution of polyvinyl alcohol (PVA-117, trademark for product made by Kuraray Co., Ltd.) and 10 parts (as solid component) of a carboxylated styrene-butadiene rubber latex (SN-304, trademark for product made by Sumitomo Naugatuc Co., Ltd.) with stirring, and then water was added to the mixture, so that the thus-obtained solid content concentration thereof became 20 wt.%, to provide a developer coating composition.

The developer coating composition thus obtained was coated on a base paper of 40 g/m² manufactured by a Fourdrinier paper machine with multi-cylinder dryers at a dry weight of 4 g/m² by means of an air knife coater and dried to provide a developer-coated paper (lower paper).

EXAMPLE 1

Using a paper stock obtained by beating a pulp mixture composed of 90 parts of LBKP (Laubholz bleached kraft pulp) and 10 parts of NBKP (Nadelholz bleached kraft pulp) to 450 cc Canadian Standard Freeness (TAPPI Standards T-227) and adding thereto 0.5 part of potassium alkenylsuccinate as a sizing agent, 5 parts of talc as a filler, and 2 parts of aluminum sulfate as a fixing agent, a paper was manufactured by a Fourdrinier paper machine with multicylinder dryers, and then polyvinyltrimethylammonium chloride was coated on the paper as a microcapsule flocculant at 0.8 g/m² by means of a size press to provide a subbing-coated base paper having a basis weight of 40 g/m² and a thickness of 52 μm.

On the above subbing-coated base paper, a coating composition composed of 28 parts (dry weight) of the microcapsule dispersion described above, 10 parts of polyvinylalcohol, and 16 parts of starch was coated at 5 g/m² (dry weight) by means of an air knife coater to provide a microcapsule-coated paper (upper paper).

When the coated surface of the microcapsule-coated paper was observed by means of a scanning electron microscope, aggregations of microcapsules were observed.

EXAMPLE 2

On the subbing-coated base paper as prepared in Example 1, a coating composition composed of 21 parts (dry weight) of the above-described microcapsule dispersion, 10 parts of polyvinylalcohol, and 16 parts of starch particles was coated at 4.4 g/m² (dry weight) by means of an air knife coater to provide a microcapsule-coated paper (upper paper).

COMPARATIVE EXAMPLE 1

By following the same procedure as Example 1 except that oxidized starch was coated at 1 g/m² by means of a size press in place of coating the flocculant, a microcapsule-coated paper (upper paper) was obtained.

When the coated surface of the microcapsule-coated paper was observed by means of a scanning electron microscope, separately scattered microcapsules were observed.

COMPARATIVE EXAMPLE 2

By following the same procedure as Example 1 except that sodium alginate was coated at 0.8 g/m² by means of a size press in place of coating the flocculant, a microcapsule-coated paper (upper paper) was obtained. When the coated surface of the microcapsule-coated paper was observed by means of a scanning electron microscope, separately dispersed microcapsules were observed even more so than in the case of Comparative Example 1.

EXAMPLE 3

Using a paper stock obtained by beating a pulp mixture of 90 parts of LBKP and 10 parts of NBKP to 450 cc Canadian Standard Freeness and adding thereto 0.5 part (dry weight) of an alkenylsuccinic anhydride emulsion as a sizing agent, 5 parts of talk as a filler, and 0.5 part of cation starch as a fixing agent, a paper was manufactured by means of a Fourdinier paper machine with multi-cylinder dryers, and basic poly-alminium chloride was coated thereon as a microcapsule flocculator at 0.5 g/m² by means of a size press to provide a subbing-coated base paper having a basis weight of 40 g/m² and a thickness of 52 μm.

The microcapsule coating composition described above was coated on the subbing-coated base paper in the same manner as in Example 1 to provide a microcapsule-coated paper (upper paper).

When the coated surface of the microcapsule-coated paper was observed by means of a scanning electron microscope, smaller aggregates of microcapsules than those in Example 1 were observed.

COMPARATIVE EXAMPLE 3

By following the same procedure as Example 3 except that oxidized starch was coated at 1 g/m² by means of a size press in place of coating the flocculant, a micro-capsule-coated paper (upper paper) was obtained.

The properties of the microcapsule-coated papers obtained in the above-described examples and comparative examples are shown in Table 1.

TABLE 1

| | Coloring Density | Smudge Density | Air Resistance (sec.) |
|---|---|---|---|
| Example 1 | 0.420 | 0.260 | 45 |
| Example 2 | 0.357 | 0.172 | 43 |
| Comparative Example 1 | 0.354 | 0.170 | 110 |
| Comparative Example 2 | 0.363 | 0.158 | 680 |
| Example 3 | 0.395 | 0.203 | 38 |
| Comparative Example 3 | 0.360 | 0.165 | 107 |

The coloring density was measured as follows. The upper paper was placed on the lower paper, letters were typewritten closely on the upper paper, and the coloring density of the lower paper was measured.

The smudge density was measured as follows. That is, the upper paper was placed on the lower paper and after applying thereto a pressure of 10 kg/cm$^2$ for 30 seconds, the coloring density of the lower paper was measured. Thus, the occurrence of smudge by friction, etc., at low pressure was evaluated.

The air resistance was measured according to TAPPI Standards T-460.

As shown in the above Table 1, the sample of Example 1 shows a higher coloring density than that of the sample of Comparative Example 1, although showing a higher stain density than the latter. On the other hand, when the coating amount of the microcapsules is reduced to 25% in Example 2, the sample shows almost the same coloring density and stain density as those of the sample in Comparative Example 1. Of course, both of Examples 1 and Example 2 are superior to Comparative Example 1 in having a low air resistance. In Comparative Example 2, the coloring density is improved but the air resistance is increased. The sample in Example 3 shows an increased coloring density as compared with that in Comparative Example 3, which shows that the coated amount of microcapsules can be reduced in Example 3 to provide an equivalent coloring density; Example 3 also shows a desirable low air resistance.

Thus, according to this invention, a high coloring density is obtained and hence a definite coloring density is obtained, using a reduced amount of microcapsules, while the air resistance is not increased.

While the invention has been described in detail and with reference to specific embodiments thereof, it will be apparent to one skilled in the art that various changes and modifications can be made therein without departing from the spirit and scope thereof.

What is claimed is:

1. A microcapsule-coated paper for a pressure-sensitive copying paper comprising a base paper having coated thereon consecutively (a) a subbing layer and (b) a coated layer including microcapsules wherein (1) said subbing layer contains a flocculant for aggregating said microcapsules and (2) said microcapsules are anionic microcapsules and the flocculant is selected from the group consisting of water-soluble cationic polymers, cationic emulsions, cationic fine particles, water-soluble cationic low-molecular weight organic compounds, and water-soluble polyvalent metal salts.

2. A microcapsule-coated paper as in claim 1, wherein said microcapsules are cationic microcapsules and the flocculant is selected from the group consisting of anionic water-soluble polymers, anionic emulsions, anionic fine particles, and water-soluble anionic low-molecular weight organic compounds.

3. A microcapsule-coated paper as in claim 1 wherein the flocculant is a water-soluble cationic polymer selected from the group consisting of polyvinylbenzyltrimethylammonium chloride, polydimethylallylammonium chloride, a dimethylallyl ammonium chloride-sulfur dioxide copolymer, polymethacryloyloxyethyltrimethylammonium chloride, polymethacryloyloxyethyl $\beta$-hydroxyethyldimethylammonium chloride, polymethacryloyloxyethyl $\beta$-hydroxy-$\gamma$-chloropropyldimethylammonium chloride, a styrenemethacryloyloxyethyl $\beta$-hydroxy-$\gamma$-chloropropyldimethylammonium chloride copolymer, polyvinylamine, polydimethylacrylamide, polydimethylaminopropylacrylamide, polyethyleneimine, quaternary polyethylenimine, an ionene-type cationic polymer, polyamide-polyamine resin, a polyamide-polyamine-epichlorohydrin resin, poly-4-vinyl-pyridine, poly-4-vinyl-N-butyl-pyridinium bromide, poly-2-methyl-1-vinyl imidazole, poly-1-vinyl-2,3-dimethylimidazolium methylsulfate, poly-2-acryloxyethyldimethylsulfonium methylsulfate, a dicyane-diamide-formalin condensate, and cationic starch.

4. A microcapsule-coated paper as in claim 1, wherein the flocculant is a cationic emulsion selected from the group consisting of methyl methacrylate-dimethylaminoethyl methacrylate copolymer, a styrene-dimethylaminoethyl methacrylate copolymer, a vinylbenzyltrimethylammonium chloride-divinylbenzene-styrene copolymer, and a methacryloyloxyethyltrimethylammonium chloride-ethylene glycol dimethylacrylate-methyl methacrylate copolymer.

5. A microcapsule-coated paper as in claim 1, wherein the flocculant is a cationic fine powder selected from the group consisting of fine urea-formalin resin powders, benzoguanamine resin fine powders, anion exchange resin fine powders, alumina zol, and alumina white.

6. A microcapsule-coated paper as in claim 1, wherein the flocculant is a cationic low-molecular weight organic compound selected from the group consisting of triethylbenzylammonium chloride, tetramethylammonium chloride, trimethyl $\beta$-hydroxy-$\gamma$-chloropropylammonium chloride, stearyltrimethylammonium chloride, stearyldimethylbenzylammonium chloride, a fatty acid-polyamine reaction product, and an epichlorohydrin quaternary compound of a fatty acid-polyamide reaction product.

7. A microcapsule-coated paper as in claim 1, wherein the flocculant is a water-soluble polyvalent metal salt selected from the group consisting of salts of aluminum, calcium, magnesium, barium, zinc, iron, and zirconium.

* * * * *